United States Patent [19]

Dikeman et al.

[11] 4,114,449

[45] Sep. 19, 1978

[54] SQUEEZE TYPE EXERCISER DEVICE WITH FORCE MEASURING GAUGE

[76] Inventors: Forrest L. Dikeman, 2925 NE. 77th Ave., Portland, Oreg. 97213; Robert C. Wilkinson, 11855 SW. 91st St., Tigard, Oreg. 97223

[21] Appl. No.: 849,496

[22] Filed: Nov. 7, 1977

Related U.S. Application Data

[63] Continuation of Ser. No. 715,436, Aug. 18, 1976, abandoned, which is a continuation of Ser. No. 576,674, May 12, 1975, abandoned.

[51] Int. Cl.[2] ..... A63B 21/30; G01L 5/02

[52] U.S. Cl. ..... 73/379; 177/208; 272/68

[58] Field of Search ..... 73/731, 379, 146; 177/208; 272/67, 68, 126, 135, 137, 141, DIG. 5, 130

[56] References Cited

U.S. PATENT DOCUMENTS

| | | | |
|---|---|---|---|
| 1,588,285 | 6/1926 | Weaver | 73/715 |
| 2,051,042 | 8/1936 | Hendel | 73/146 |
| 2,577,100 | 12/1951 | Alvarez | 73/715 |
| 2,708,367 | 5/1955 | Lusk | 73/379 R |
| 3,374,762 | 3/1968 | Baldwin | 73/379 R A |
| 3,413,243 | 11/1968 | Griffin | 272/68 X |
| 3,611,807 | 10/1971 | Brandell | 272/68 |
| 3,670,574 | 6/1972 | Edwards | 73/141 A |
| 3,818,766 | 6/1974 | Fleischacker | 73/715 |

*Primary Examiner*—Richard J. Johnson
*Attorney, Agent, or Firm*—Oliver D. Olson

[57] ABSTRACT

An exerciser device comprises an elastic compression body which is configured to accommodate a wide variety of exercises for different muscle groups and enclosed within the body is a flexible reservoir of liquid communicating with a transparent gauge tube disposed at the surface of the body for viewing the liquid level therein by the person using the exerciser. The end of the gauge tube opposite the reservoir communicates with an air compression chamber in which compressed air resiliently opposes movement of the liquid in the gauge tube in response to compression of the elastic body.

2 Claims, 3 Drawing Figures

SQUEEZE TYPE EXERCISER DEVICE WITH FORCE MEASURING GAUGE

This is a continuation of application Ser. No. 715,436, filed Aug. 18, 1976, now abandoned which was a continuation application Ser. No. 576,674 filed May 12, 1975 also now abandoned.

BACKGROUND OF THE INVENTION

This invention relates to a squeeze type exerciser for use in building and toning body muscles. In particular, it relates to such an exerciser device having integrated therewith a gauge for indicating the amount of force applied.

Squeeze type exerciser devices of diverse forms are well known in the art and they include the type having an elastic compression body, such as is employed in the present invention. However, such prior exerciser devices having an elastic compression body do not provide practicable means for indicating and displaying the level of forces applied. Thus, for example, those that do provide force indicating means utilize mechanisms that involve moving parts which are subject to damage, wear and deterioration which result in premature malfunction of the device. Some include components which, in operation, project from the periphery of the elastic compression body and thus are subject to damage and otherwise limit the utility of the device.

SUMMARY OF THE INVENTION

In its basic concept, the exerciser device of this invention comprises an elastic compression body having integrated within its periphery a force indicating gauge characterized by having no mechanical moving parts but has an indicator component visible at the outer surface of the body for indicating to the user the amount of compressive force that is being applied to the compression body.

It is by virture of the foregoing basic concept that the principal objective of this invention is achieved; namely, to overcome the aforementioned disadvantages and limitations of squeeze type exerciser devices of the prior art.

Another object of this invention to provide an exerciser device of the class described wherein the gauge may be varied to allow full scale indication for differing amounts of applied force, whereby to render the device usable by body types of widely varying capabilities for exercising many different muscle groups.

A further object of this invention is to provide a squeeze type exerciser device of the class described which is of simplified construction for economical manufacture and is of rugged, unitary design permitting severe treatment in use.

The aforegoing and other objects and advantages of this invention will appear from the following detailed description, taken in connection with the accompanying drawing of a preferred embodiment.

DESCRIPTION OF THE PREFERRED EMBODIMENT

Figure 3:
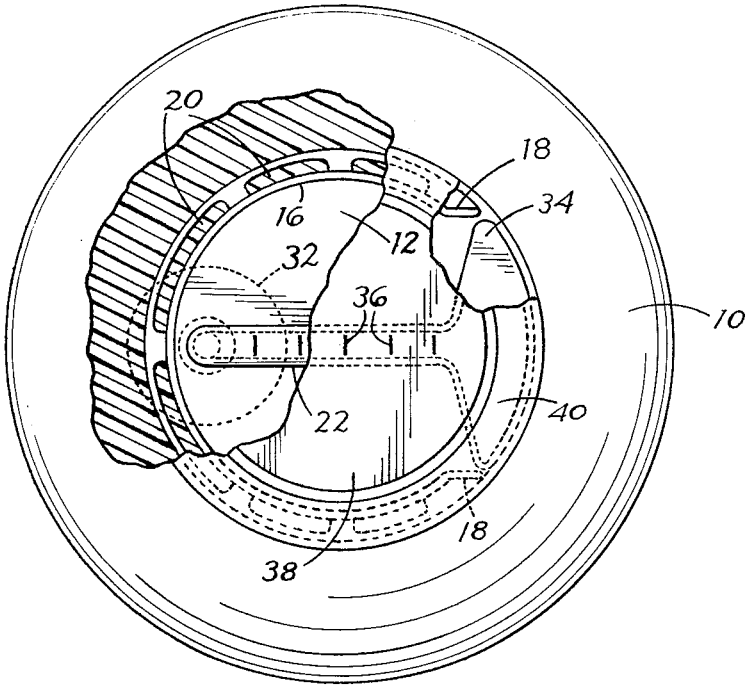
FIG. 3 is a fragmentary plan view as viewed from the top in FIG. 1, portions being broken away to disclose details of internal construction.

Referring to the drawing, the exerciser includes an elastic compression body 10. As illustrated, it is a homogeneous, substantially spherical element fabricated of a light weight compressible material as by the molding of a pourable foam material such as poly-foam, or sponge rubber. For general purpose exerciser use, the body preferably is about ten inches in diameter, although larger or smaller sizes may be desirable for use in specific applications.

Gauge means is integrated with and confined substantially within the periphery of the elastic compression body 10. Moreover, it is characterized by having no mechanical moving parts. In the embodiment illustrated, it is formed of an assembly of components of high impact synthetic thermoplastic resin. Thus, it includes a structural support plate 12 of general circular outline provided at its underside with crossing reinforcing ribs 14. Extending upward from the plate slightly inward of its periphery is an arcuate wall 16 terminating in circumferentially spaced, outwardly directed ends 18 (FIG. 3). The space between the upstanding wall 16 and the outer periphery of the plate is provided with a plurality of spaced openings 20.

An elongated channel-shaped member 22 of transparent plastic is hermetically sealed to the upper side of the support plate 12 and forms with the latter a liquid tight enlongated indicator tube 24. One end of the tube communicates through an opening 26 in the plate 12 with a downwardly depending hollow coupler 28 to which is secured the integral neck 30 of a resiliently deformable reservoir 32 for a gauge liquid. As illustrated, the reservoir is in the form of a flexible bulb of spherical shape, although it is to be understood that it may take the form of a flat bladder or other suitable shape, as desired.

The end of the indicator tube 24 opposite the reservoir 32 is enlarged transversely to form an air compression chamber 34 which spans the space between the terminal ends 18 of the upstanding wall 16.

The transparent tube 24 between the coupler 28 and the air chamber 34 may be provided with longitudinally spaced graduations 36 forming a scale for the purpose of indicating the squeezing force applied to the exerciser device, as explained more fully hereinafter.

A circular cover 38 of transparent impact type plastic overlies the gauge component and is bonded integrally thereto by means of a peripheral bezel 40 which is bonded to the transparent cover 38 and also to the annular upstanding wall 16.

The reservoir 32 is filled with an indicator liquid, for example to the level 42 indicated when the elastic compression body is in relaxed condition. The indicating fluid preferably is colored water with a suitable proportion of antifreeze sufficient to prevent freezing of the liquid, and sufficient wetting agent to form a distinct meniscus in the indicator tube 24 for referencing the top end of the liquid column with the graduation marks 36.

The foregoing integrated assembly of plastic gauge components is integrated with the elastic compression body 10 as by placing the gauge assembly in a casting mold and then pouring into the mold the foam material of poly-foam or sponge rubber. The foam material thus flows around the coupler 28 and reservoir 32 and through the arcuate openings 20 in the plate 12 and into all of the voids between the plate and bezel, thereby bonding and effectively locking the gauge assembly to the body forming a rugged, unitary structure capable of withstanding severe treatment without damage, malfunctioning, or injury to the user.

In the preferred embodiment illustrated, a lower portion of the body 10 is provided with a flattened base portion 44 to prevent it from rolling about either during storage when not in use, or during the performance of certain exercises. The base portion preferably is located relative to the gauge so as to display the gauge tube 24 portion at an incline facing the user. In this position the indicating fluid in the tube 24 gravitates downward into the reservoir 32. Further, the base portion preferably is of concave configuration, as illustrated, since continued squeezing of the body 10 throughout its useful life tends partially to fill in the concave portion. There thus is assured a plane peripheral surface forming a stable support for the body when the exerciser device is in storage, or when it is desired to be held stable on a support for certain exercises.

Figure 1:
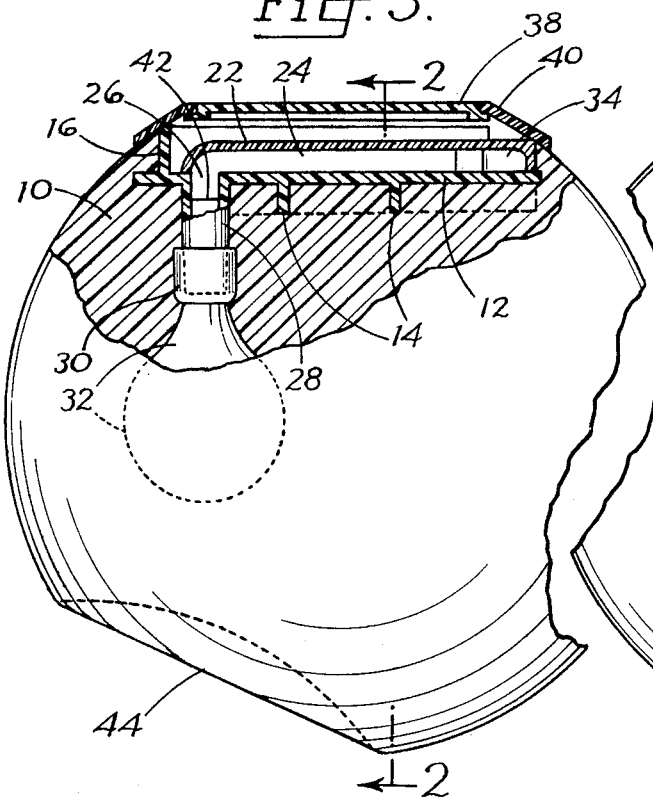
FIG. 1 is a fragmentary side elevation, partly broken away, of an exerciser device embodying the features of this invention.

The exerciser device described hereinbefore may be used in a variety of ways. For example, in the position of FIG. 2, it may be grasped between the hands with the indicator tube 24 facing the user. When thus grasped between the palms of the hands, the greater amount of compressive force is applied in the area of the heels of the hands, substantially in line with the offset position of the reservoir 32 shown in FIG. 1.

Figure 2:
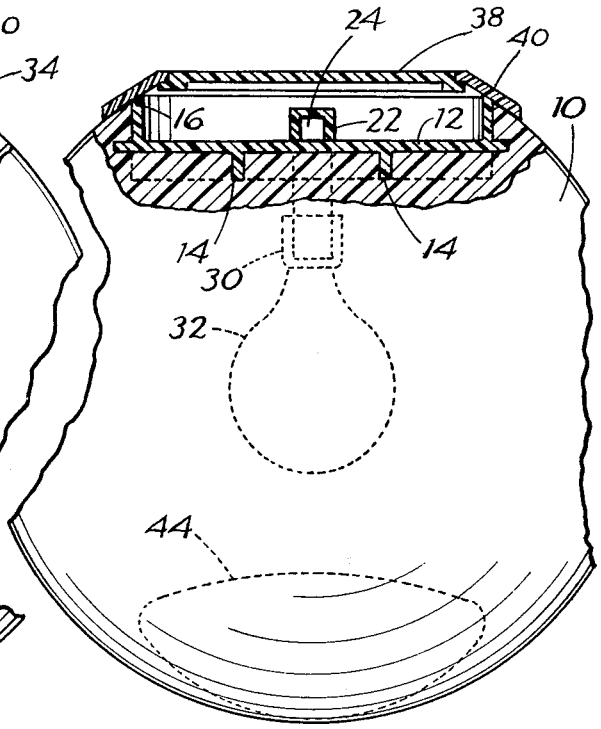
FIG. 2 is a fragmentary sectional view taken along the line 2—2 in FIG. 1.

When the user compresses the body 10 from the opposite sides, as viewed in FIG. 2, the reservoir 32 is deformed proportionately and a corresponding amount of fluid is squeezed out of it into the transparent indicator tube 24. By relating the liquid meniscus with the scale graduations 36, the user has a visual indication of the amount of force he has applied to the body. The graduations may be identified numerically in arbitrary units, or in units indicating the poundage or other unit of force applied. In either case, it provides the user with reference points which may be related to certain muscular activities and which may provide the user with a psychological stimulus to exceed those points as exercise progresses.

It is to be noted that the indicating liquid travels upward through the transparent tube 24 toward the air compression chamber 34 in proportion to the compression of the body 10 and in proportion to the volume of air displaced above the indicating liquid. Thus, the volume of the chamber 34 determines how far the indicating fluid rises in the transparent tube 24 with the application of a given force on the compression body 10. By providing gauge components with air chambers 34 of different volumes, full scale readings of liquid level in the indicator tube can be achieved by different amounts of applied force to the body. The exerciser device thus may be provided in a variety of strength sizes suitable for use by individuals of all ages and physical abilities.

It is to be noted that the exerciser device illustrated herein may be used for the performance of many types of exercises. The user may squeeze the compression body between the hands or knees, push against it with the arms or legs, or perform a number of exercises each designed to benefit a different muscle or muscle group. Typical of these exercises are those described and illustrated in ARCHIVES OF PHYSICAL MEDICINE AND REHABILITATION, May, 1967 by Robert L. Swezey, M.D.

It will be apparent to those skilled in the art that various changes may be made in the size, shape, type, number and arrangement of parts described hereinbefore without departing from the spirit of this invention.

Having now described our invention and the manner in which it may be used, we claim:

1. A body exerciser device, comprising:

a. an elastic compression body, and b. a gauge integral with and confined within the periphery of the elastic compression body throughout the operating range of the gauge, the gauge comprising:

1. a resiliently deformable fluid reservoir confined within and surrounded by the elastic compression body, the reservoir being encapsulated within the body with substantially the entire external surface of the reservoir bonded to and in direct contact with said body,
2. compression indicating means communicating within the reservoir and bonded integrally to the body and confined within the periphery of the elastic compression body throughout its operating range, the indicating means being visible at the periphery of the body, and
3. indicating fluid contained within the reservoir and operable upon compression of the elastic body to compress the reservoir and register said compression on the visible indicating means.

2. The exerciser device of claim 1 wherein the compression indicating means comprises an elongated transparent indicator tube visible at the surface of the body but confined within the periphery of the body, and the indicating fluid is a liquid movable along the indicator tube in response to a compression of the body from opposite sides inwardly toward the elongated indicator tube.

* * * * *